US011022260B2

(12) United States Patent
Chen et al.

(10) Patent No.: US 11,022,260 B2
(45) Date of Patent: Jun. 1, 2021

(54) LIGHTING APPARATUS WITH A LIGHT MODULE WITH ELONGATED HOUSING AND A BASE BRACKET HOLDING THE ELONGATED HOUSING

(71) Applicant: XIAMEN ECO LIGHTING CO. LTD., Xiamen (CN)

(72) Inventors: Chunteng Chen, Xiamen (CN); Chuntian Qiu, Xiamen (CN); Lei Zhang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/860,033

(22) Filed: Apr. 27, 2020

(65) Prior Publication Data

US 2021/0088192 A1 Mar. 25, 2021

(51) Int. Cl.

| | |
|---|---|
| ***F21S 8/04*** | (2006.01) |
| ***F21V 23/00*** | (2015.01) |
| ***F21V 17/16*** | (2006.01) |
| *F21Y 115/10* | (2016.01) |

(52) U.S. Cl.

CPC ..... *F21S 8/04* (2013.01); *F21V 17/16* (2013.01); *F21V 23/003* (2013.01); *F21Y 2115/10* (2016.08)

(58) Field of Classification Search

CPC ..... F21S 8/026; F21S 8/043; F21Y 2115/10; F21V 21/025; F21V 17/16; F21V 7/162; F21V 17/164; F21V 17/166; F21V 17/168

See application file for complete search history.

(56) References Cited

U.S. PATENT DOCUMENTS 8,777,448 B2 * 7/2014 Shimizu ..... F21K 9/20 362/235

9,976,735 B2 * 5/2018 Honda ..... F21V 21/025

* cited by examiner

*Primary Examiner* — Robert J May

(74) *Attorney, Agent, or Firm* — Chun-Ming Shih; Lanway IPR Services

(57) ABSTRACT

A lighting apparatus, includes a light module and a base bracket. The light module has an elongated housing and LED modules. The LED modules are disposed in the elongated housing and emitting light passing through a light passing cover of the elongated housing. The base bracket is fixed to a ceiling with a first fixing structure. The bracket has a second fixing structure for holding the elongated housing of the light module.

18 Claims, 9 Drawing Sheets

LIGHTING APPARATUS WITH A LIGHT MODULE WITH ELONGATED HOUSING AND A BASE BRACKET HOLDING THE ELONGATED HOUSING

FIELD

The present application is related to a lighting apparatus and more particularly related to a lighting apparatus with an easy installation design.

BACKGROUND

Electroluminescence, an optical and electrical phenomenon, was discovered in 1907. Electroluminescence refers to the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually being replaced. However, the cost of initial commercial LEDs was extremely high, making them rare to be applied for practical use. Also, LEDs only illuminated red light at early stage. The brightness of the light could only be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

It is also important to consider how to conveniently install a lighting apparatus. Particularly, many societies face aging problems. More and more old people need to replace or install lighting devices by themselves. Labor cost for installing lighting devices is also increasing. It is therefore beneficial to design a better way to install various lighting devices.

SUMMARY

A lighting apparatus, includes a light module and a base bracket.

The light module has an elongated housing and LED modules. The LED modules are disposed in the elongated housing and emitting light passing through a light passing cover of the elongated housing.

The base bracket is fixed to a ceiling with a first fixing structure. The bracket has a second fixing structure for holding the elongated housing of the light module.

In some embodiments, the first fixing structure are screws fixing to screw holes of the base bracket.

In some embodiments, the base bracket has a first lateral plate arm and a second lateral plate arm.

In some embodiments, the first lateral plate arm has a first elongated inwardly convex structure for clipping a first elongated concave structure of the elongated housing of the light module. The second lateral plate arm has a second elongated inwardly convex structure for clipping a second elongated concave structure of the elongated housing of the light module.

In some embodiments, the first lateral plate arm and the second lateral plate arm are elastic and deformed to expand for receiving the light module and recover to clip the light module.

In some embodiments, the first elongated inwardly convex structure and the second elongated inwardly convex structure together form a track for inserting the light module In some embodiments, the elongated housing of the light module has a top part with less diameter than a bottom part.

In some embodiments, the lighting apparatus may also include a first end box and a second end box disposed on two ends of the light module.

In some embodiments, the first end box and the second end box are connected to the base bracket.

In some embodiments, at least one of the first end box and the second end box encloses a driver for converting an external power to supply driving current to the light module.

In some embodiments, the first end box and the second end box contain additional light sources for emitting lights with directions differently from the light module.

In some embodiments, the base bracket relays electricity from an external power source to the light module.

In some embodiments, the base bracket has a driver circuit for converting the external power to a driving current supplied to the light module.

In some embodiments, the ceiling is installed with a grid system having multiple grids, each grid provides a structure connector corresponding to the first fixing structure of the base bracket and supplies electricity to the bracket via the first fixing structure.

In some embodiments, the base bracket has a second slot for installing an attached module in addition to the light module.

In some embodiments, the attached module interacts with the light module via an electricity loop of the base bracket.

In some embodiments, the attached module receives power from a driver of the light module via the electricity loop of the base bracket.

In some embodiments, the attached module communicates control signals via an electricity loop of the base bracket to the light module.

In some embodiments, an additional base bracket is used for holding the same light module.

In some embodiments, there is a security string disposed for connecting the base bracket and the light module.

In some embodiments, there is a security string disposed for connecting the base bracket to another base bracket.

DETAILED DESCRIPTION

Figure 1:
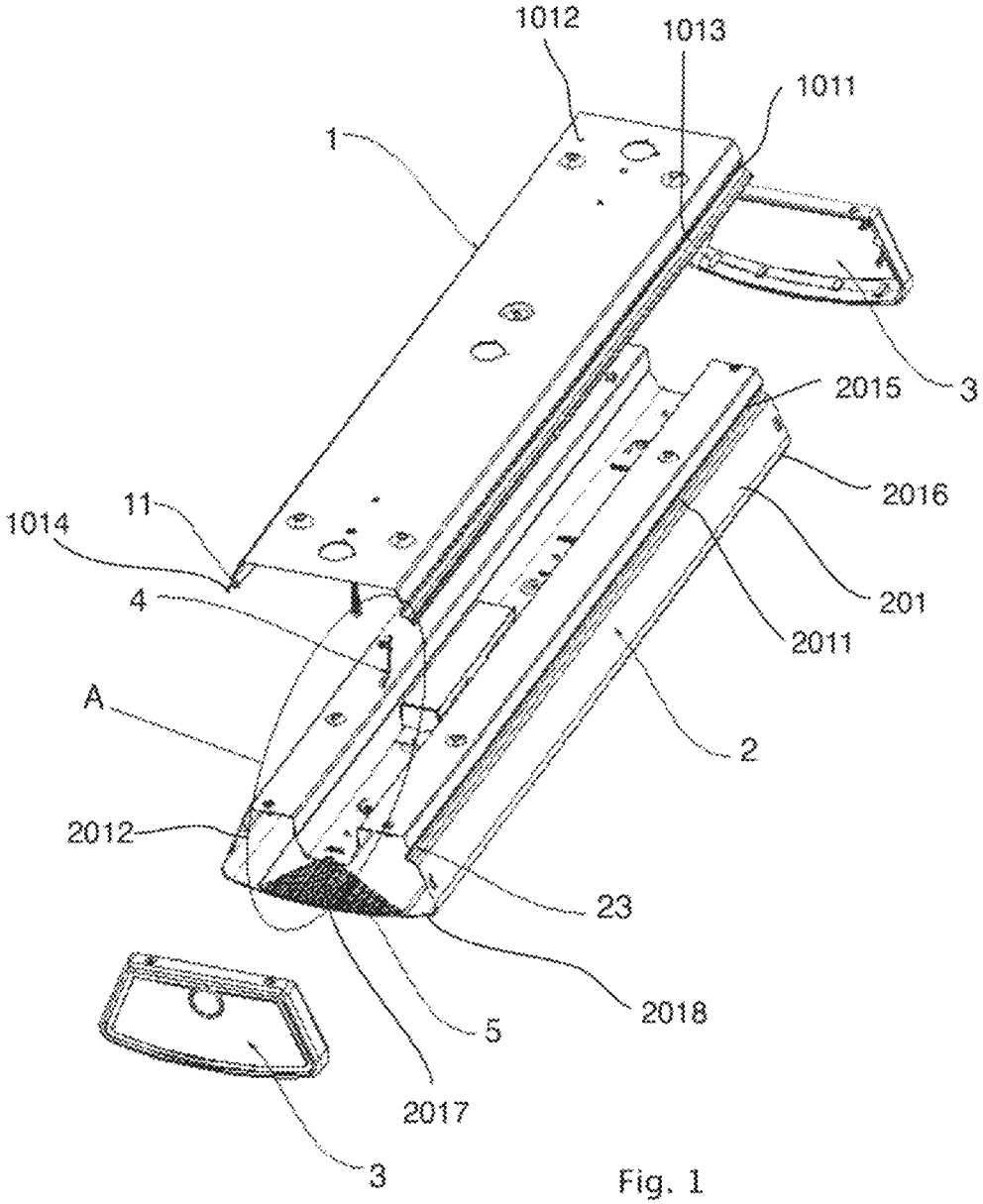
FIG. 1 illustrates an embodiment of a lighting apparatus.
Figure 2:
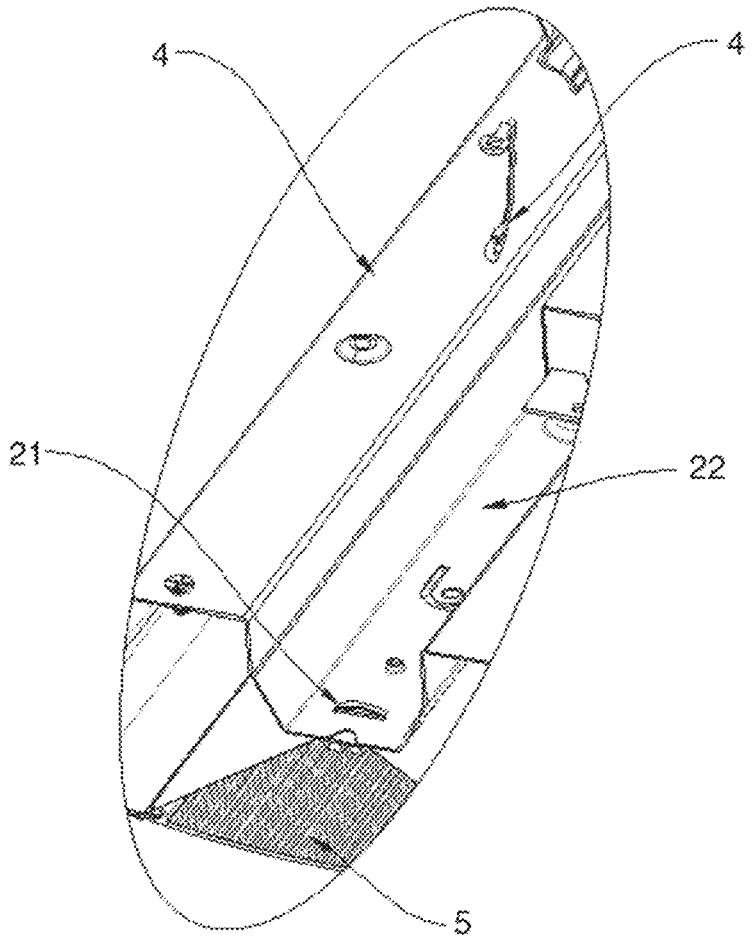
FIG. 2 illustrates a partial view of an embodiment of the lighting apparatus.

Please refer to FIG. 1 and FIG. 2. An embodiment of a lighting apparatus includes a base bracket 1 and a light module 2. There is a security string 4 connecting the base bracket 1 to the light module to prevent the light module 2 falling from the base bracket for any accidental situation. The base bracket 1 is fixed to a ceiling with a first fixing structure. In this example, the fixing structure includes two screws.

There is an entrance below the base bracket 1. The light module 2 is installed to the base bracket 1 from the entrance. In this example, the base bracket 1 has first lateral plate 1011 and a second lateral plate 1012. The first lateral plate 1011 has a first elongated inwardly convex structure 1013. The second lateral plate 1012 has a second elongated inwardly convex structure 1014. The first elongated inwardly convex structure 1013 and the second elongated inwardly convex structure 1014 together for a first connector 11.

The light module 2 has an elongated housing 201. There is a first elongated concave structure 2011 on a first side of the elongated housing 201 and a second elongated concave structure 2012 on a second side of the elongated housing 201. The first elongated concave structure 2011 and the second elongated concave structure 2102 together form a second connector 23. The first connector 21 and the second connector 23 are connected so as to fix the light module 2 to the base bracket 1.

There are at least two ways for connecting the first connector 21 to the second connector 23. Specifically, in the first way, the first connector 21 and the second connector 23 are rigid structures and the first connector 11 form a track, and the second connector 23 of the light module is inserted into the track to be connected to the first connector 21.

In this example, the elongated housing 201 of the light module 2 has a top part 2015 having less diameter than a bottom part 2016. In other words, the top part 2015 of the elongated housing 201 is smaller than the bottom part 2016 so that to expand more areas for emitting light.

There are two end boxes 3, a first end box and a second end box, fixing to two ends of the light module 2.

The base bracket 1 fix the light module 2 to a desired position of the ceiling. There are LED modules 2017 disposed in the elongated housing 201. There is a light passing cover 2018 on the elongated housing 201 for the light emitted by the LED modules 2017 to pass through. The light passing cover 2018 may have a diffusion cover or a transparent cover with multiple lens for forming light beams.

One end of the security string 4 is fixed to the light module 2 and the other end of the security string 4 is fixed to the base bracket 1. If the base bracket 1 fails to hold the light module 2 with the connection between the first connector 21 and the second connector 23, the security string 4 helps keeps connection between the light module 2 and the base bracket 1. The end boxes 3 also prevent dust to go into the light module 2.

Figure 3:
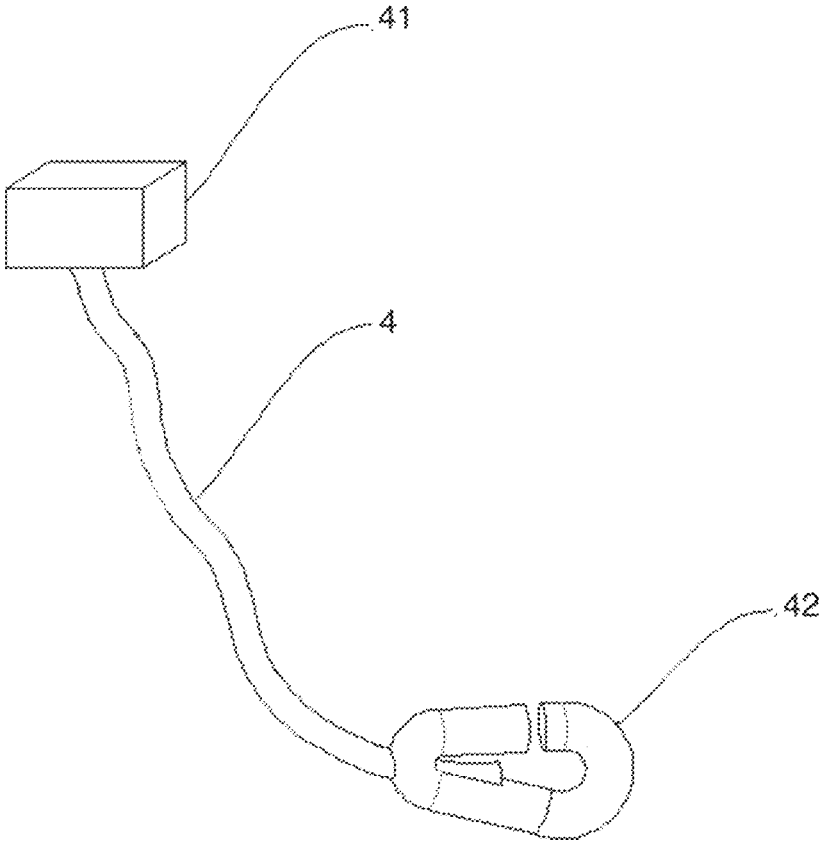
FIG. 3 illustrates a partial view of an embodiment of the lighting apparatus.
Figure 5:
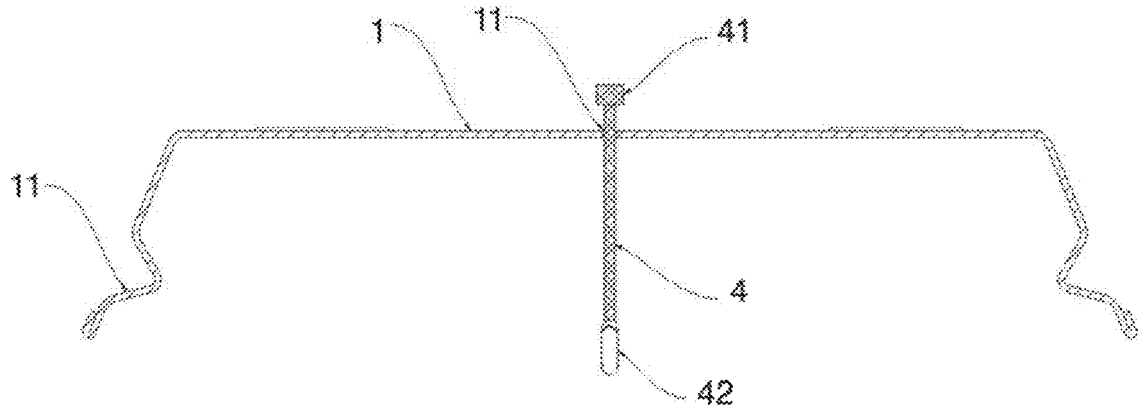
FIG. 5 shows a side view of an embodiment of the lighting apparatus.

Please refer to FIG. 3 and FIG. 5. The base bracket 1 includes a top plate, a first lateral plate and a second lateral plate. The top plate is fixed to the ceiling with a first fixing structure. The first lateral plate and the second lateral plate are disposed on two sides of the top plate. There is a limiting block 41 disposed at end of the security string 4 to ensure the connection between the base bracket 1 and the light module 2 because the limiting block has larger size, not able to pass through an installation hole for passing the security string 4.

Figure 4:
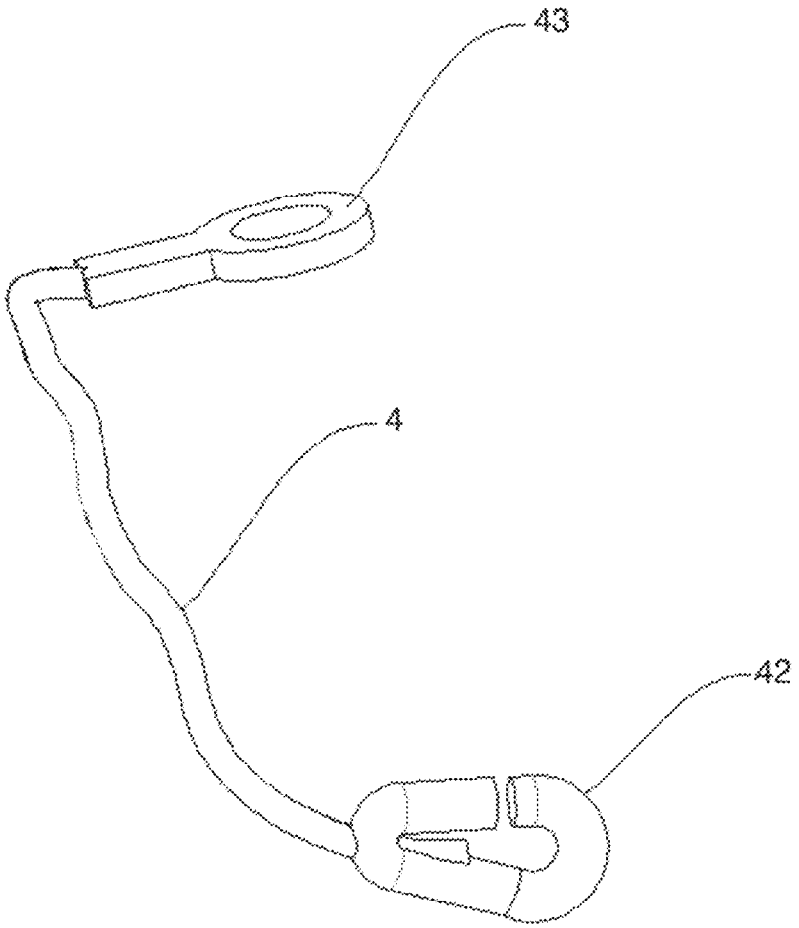
FIG. 4 illustrates a partial view of an embodiment of the lighting apparatus.
Figure 6:
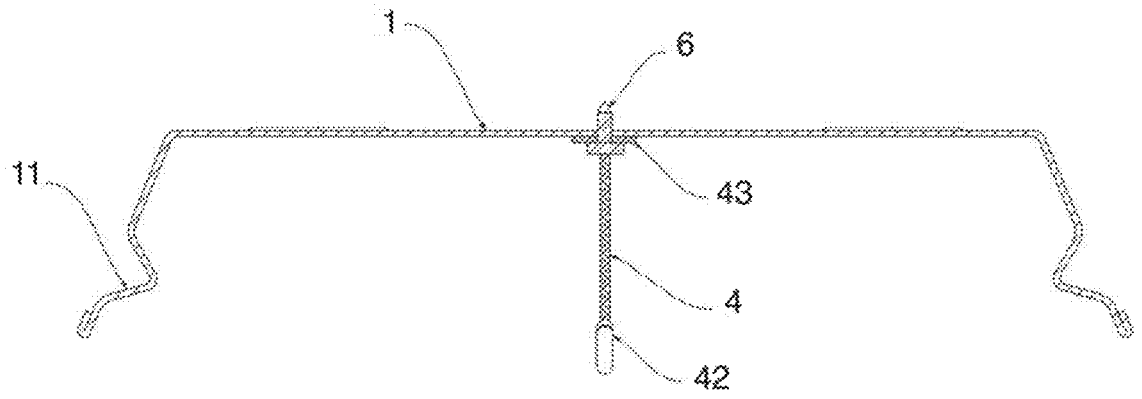
FIG. 6 shows a side view of an embodiment of the lighting apparatus.

Please refer to FIG. 4 and FIG. 6. The screw 6 passes a connector ring and the top plate for fixing the base bracket 1 to the ceiling.

Please refer to FIG. 3. There is a connector as a spring buckle 42 between the security string 4 and the light body 2. The spring buckle 42 is pressed to release connection of the installation hole 21 from the spring buckle 42.

Please refer to FIG. 1 and FIG. 2. There is a container groove 22 on top of the light body 2 for storing the security string 4. The container groove 22 may also be used for containing a driver box or other components.

Please refer to FIG. 1 and FIG. 2, the light passing cover 5 is detachable from the light module 2 to replace another light passing cover with different parameters. Various reflector may be installed to the light module 2 and different optical components like lens may be installed to the light module 2 to increase more flexibility and functions of the lighting apparatus. For example, light beam angles, colors and other parameters may be adjusted by installing corresponding components to the light module.

Figure 7:
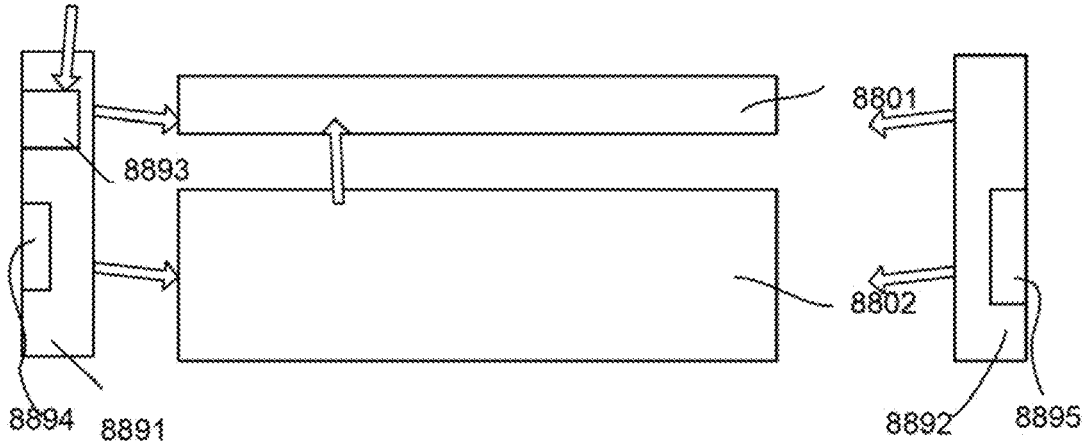
FIG. 7 shows a schematic view of an embodiment of the lighting apparatus.

Please refer to FIG. 7. A base bracket 8801 is firstly fixed to a ceiling or a surface or another device. The light module 8802 is then attached to the base bracket 8801. In addition, the connection between the light module 8802 and the base bracket 8801 may be detachable so as to replace another light module 8802 to the same base bracket 8801.

In FIG. 7, the first end box 8891 and the second end box 8892 are connected to the base bracket 8801 and the light module 8802 at the same time. In other words, such example shows that both the base bracket 8801 and the light module 8802 are connected to the two end boxes 8891, 8892 to further enhance connection of the base bracket 8801 and the light module 8802.

In FIG. 7, at least one of the first end box 8891 and the second end box 8892 encloses a driver 8893 for converting an external power to supply driving current to the light module 8802.

In FIG. 7, the first end box 8891 and the second end box 8892 contain additional light sources 8894, 8895 for emitting lights with directions differently from the light module 8802.

Figure 8:
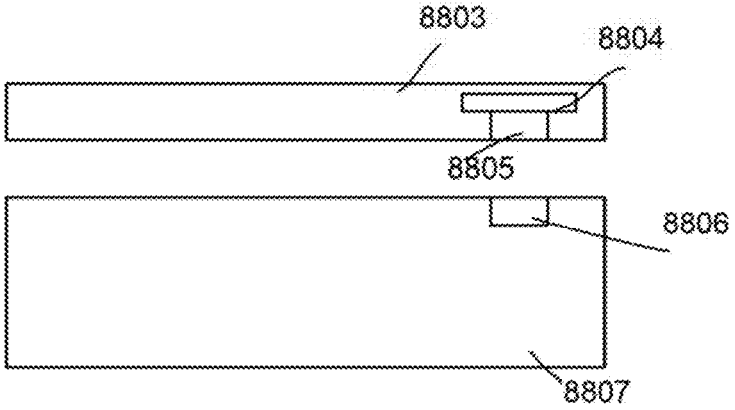
FIG. 8 shows a schematic view of an embodiment of the lighting apparatus.

In FIG. 8, the base bracket 8803 has a driver 8804 and an electrode 8805. The light module 8807 has a corresponding electrode 8806 for connecting the electrode 8805 to receive a driving current generated by the driver 8804.

Figure 13:
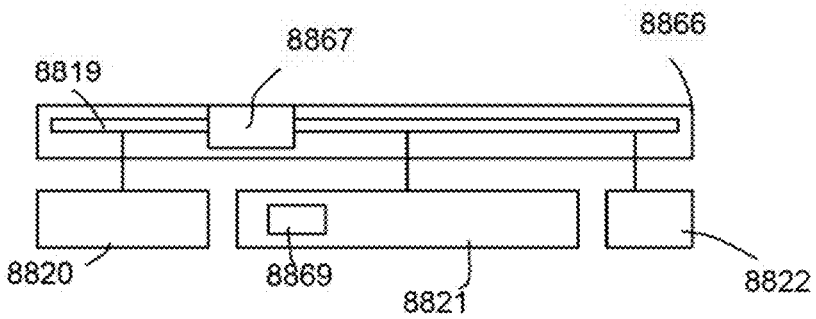
FIG. 13 shows a schematic view of an embodiment of the lighting apparatus.

In FIG. 13, the base bracket 8866 has a conductive path 8819 relays electricity from an external power source to the light module 8821.

In FIG. 13, the base bracket 8866 has a driver circuit 8819 for converting the external power to a driving current supplied to the light module 8821.

Figure 9:
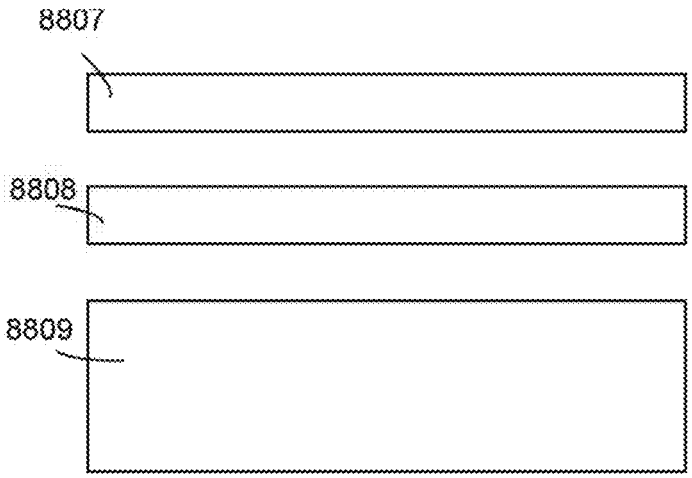
FIG. 9 shows a schematic view of an embodiment of the lighting apparatus.
Figure 10:
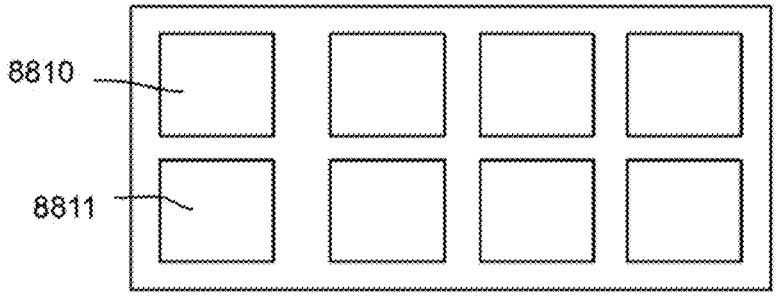
FIG. 10 shows a schematic view of an embodiment of the lighting apparatus.

In FIG. 9 and FIG. 10, the ceiling is installed with a grid system 8807 having multiple grids 8810, 8811, each grid provides a structure connector corresponding to the first fixing structure of the base bracket and supplies electricity to the bracket via the first fixing structure. In other words, the base bracket 8808 is fixed to the grid system 8807 for receiving electricity and structure support. The light module 8809 is attached to the base bracket 8808.

Figure 11:
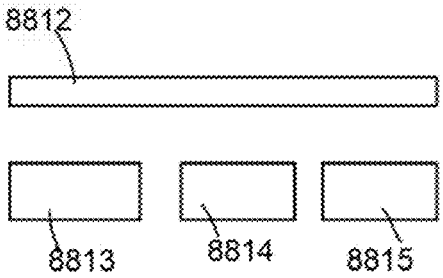
FIG. 11 shows a schematic view of an embodiment of the lighting apparatus.

In FIG. 11, the base bracket 8812 has a second slots for installing an attached module 8813, 8815 in addition to the light module 8814.

Figure 12:
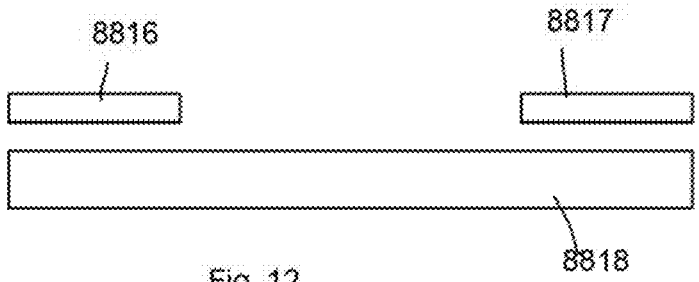
FIG. 12 shows a schematic view of an embodiment of the lighting apparatus.

In FIG. 12, the attached module interacts with the light module via an electricity loop of the base bracket.

In FIG. 13, the attached module 8821 receives power from a driver 8869 of the light module 8821 via the electricity loop 8819 of the base bracket 8866. The electricity loop 8819 may be a set of wires or conductive bars for guiding electricity to pass through for connecting multiple electricity components.

In FIG. 13, the attached modules 8820, 8822 communicate control signals via an electricity loop 8819 of the base bracket 8866 to the light module 8821.

In FIG. 12, an additional base bracket 8817 and an original base bracket 8816 are together used for holding the same light module 8818.

In some embodiments, there is a security string disposed for connecting the base bracket to another base bracket.

In some embodiments, there is a security string disposed for connecting the base bracket to another base bracket.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light module with an elongated housing and LED modules, the LED modules being disposed in the elongated housing and emitting light passing through a light passing cover of the elongated housing;

a base bracket fixed to a ceiling with a first fixing structure, the bracket having a second fixing structure for holding the elongated housing of the light module; and a first end box and a second end box disposed on two ends of the light module, wherein the first end box and the second end box are connected to the base bracket.

2. The lighting apparatus of claim 1, wherein the first fixing structure are screws fixing to screw holes of the base bracket.

3. The lighting apparatus of claim 1, wherein the base bracket has a first lateral plate arm and a second lateral plate arm.

4. The lighting apparatus of claim 3, wherein the first lateral plate arm has a first elongated inwardly convex structure for clipping a first elongated concave structure of the elongated housing of the light module, the second lateral plate arm has a second elongated inwardly convex structure for clipping a second elongated concave structure of the elongated housing of the light module.

5. The lighting apparatus of claim 4, wherein the first lateral plate arm and the second lateral plate arm are elastic and deformed to expand for receiving the light module and recover to clip the light module.

6. The lighting apparatus of claim 4, wherein the first elongated inwardly convex structure and the second elongated inwardly convex structure together form a track for inserting the light module.

7. The lighting apparatus of claim 1, wherein the elongated housing of the light module has a top part with less diameter than a bottom part.

8. The lighting apparatus of claim 1, wherein at least one of the first end box and the second end box encloses a driver for converting an external power to supply driving current to the light module.

9. The lighting apparatus of claim 1, wherein the first end box and the second end box contain additional light sources for emitting lights with directions differently from the light module.

10. The lighting apparatus of claim 1, wherein the base bracket relays electricity from an external power source to the light module.

11. The lighting apparatus of claim 10, wherein the base bracket has a driver circuit for converting the external power to a driving current supplied to the light module.

12. The lighting apparatus of claim 1, wherein the ceiling is installed with a grid system having multiple grids, each grid provides a structure connector corresponding to the first fixing structure of the base bracket and supplies electricity to the bracket via the first fixing structure.

13. The lighting apparatus of claim 1, wherein the base bracket has a second slot for installing an attached module in addition to the light module.

14. The lighting apparatus of claim 13, wherein the attached module communicates control signals via an electricity loop of the base bracket to the light module.

15. The lighting apparatus of claim 13, wherein the attached module interacts with the light module via an electricity loop of the base bracket.

16. The lighting apparatus of claim 15, wherein the attached module receives power from a driver of the light module via the electricity loop of the base bracket.

17. The lighting apparatus of claim 1, wherein an additional base bracket is used for holding the same light module.

18. The lighting apparatus of claim 1, wherein there is a security string disposed for connecting the base bracket and the light module.

* * * * *